US005785615A

United States Patent [19]

Kosmalski

[11] Patent Number: 5,785,615

[45] Date of Patent: Jul. 28, 1998

[54] HOCKEY GAME APPARATUS

[76] Inventor: Richard L. Kosmalski, 601 Baldwin La., Wilmington, Del. 19803

[21] Appl. No.: 823,339

[22] Filed: Mar. 24, 1997

[51] Int. Cl.[6] ..... A63B 67/00

[52] U.S. Cl. ..... 473/471; 473/560; 273/108.5

[58] Field of Search ..... 273/108.1, 108.5, 273/108.21, 85 R; 473/560, 471

[56] References Cited

U.S. PATENT DOCUMENTS

| | | | |
|---|---|---|---|
| 1,593,421 | 7/1926 | Blum | 273/108.5 |
| 1,641,525 | 9/1927 | Boessow | 273/108.5 |
| 4,560,163 | 12/1985 | Erickson | 273/108.1 |
| 5,417,421 | 5/1995 | Bagley | 273/108.5 |
| 5,609,336 | 3/1997 | Tashjian | 473/560 |
| 5,613,687 | 3/1997 | Zaffino | 273/108.5 |

*Primary Examiner*—Mark S. Graham

[57] ABSTRACT

A hockey game apparatus including a playing surface defined by a rectangular enclosure. The rectangular enclosure has an open top end, an open bottom end and a peripheral boundary disposed therebetween. The enclosure has a plurality of openings therethrough. A pair of adjustably sized hockey sticks are included for slapping a ball. The ball is dimensioned for being received through the openings of the rectangular enclosure.

2 Claims, 3 Drawing Sheets

HOCKEY GAME APPARATUS

BACKGROUND OF THE INVENTION

1. Field of the Invention

The present invention relates to a hockey game apparatus and more particularly pertains to playing a hockey game in an enclosed area with a hockey game apparatus.

2. Description of the Prior Art

The use of hockey implements is known in the prior art. More specifically, hockey implements heretofore devised and utilized for the purpose of aiding in the participation in a hockey game are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,127,649 to Carbonero discloses a foam hockey stick blade cover.

U.S. Pat. No. 5,429,360 to Capecci, Jr. discloses a street hockey puck.

U.S. Pat. No. 5,435,548 to Leduke et al. discloses a hockey stick blade.

U.S. Pat. No. Des. 349,738 to Naegele, III et al. discloses the ornamental design for a boundary barrier for a sports playing field.

U.S. Pat. No. 5,328,652 to Thomson discloses a method for making a foamed goal pad for hockey.

U.S. Pat. No. 4,153,253 to White, Sr. discloses a road hockey puck.

While these devices fulfill their respective, particular objective and requirements, the aforementioned patents do not describe a hockey game apparatus for playing a hockey game in an enclosed area.

In this respect, the hockey game apparatus according to the present invention substantially departs from the conventional concepts and designs of the prior art, and in doing so provides an apparatus primarily developed for the purpose of playing a hockey game in an enclosed area.

Therefore, it can be appreciated that there exists a continuing need for new and improved hockey game apparatus which can be used for playing a hockey game in an enclosed area. In this regard, the present invention substantially fulfills this need.

SUMMARY OF THE INVENTION

In the view of the foregoing disadvantages inherent in the known types of hockey implements now present in the prior art, the present invention provides an improved hockey game apparatus. As such, the general purpose of the present invention, which will be described subsequently in greater detail, is to provide a new and improved hockey game apparatus and method which has all the advantages of the prior art and none of the disadvantages.

To attain this, the present invention essentially comprises a playing surface defined by a rectangular enclosure. The rectangular enclosure has an open top end, an open bottom end and a peripheral boundary disposed therebetween. The peripheral boundary is further defined by opposed elongated side walls and opposed shorter end walls removably secured together at ends thereof. Each of the elongated side walls is further defined by a pair of segments of equal lengths. The rectangular enclosure has a central divider extending between the pair of segments of the opposed elongated side walls to divide the rectangular enclosure into two equally dimensioned playing zones. Each of the opposed shorter end walls have an inverted U-shaped opening through a central portion thereof. The central divider has a pair of inverted U-shaped openings. The central divider has a recess formed in an upper edge thereof intermediately disposed between the pair of inverted U-shaped openings. The apparatus includes a pair of adjustably sized hockey sticks. Each of the hockey sticks has a linear upper portion, a generally L-shaped lower portion and a linear intermediate portion removably positioned therebetween. A lower end of the upper portion has a tab extending outwardly therefrom. The tab has an aperture therethrough. An upper end of the intermediate portion has a recess formed inwardly thereof for selectively receiving the tab therein. A locking screw extends inwardly of the recess from an upper surface of the intermediate portion to engage the aperture in the tab. A lower end of the intermediate portion has a tab extending outwardly therefrom. The tab has an aperture therethrough. An upper end of the lower portion has a recess formed inwardly thereof for receiving one of the tabs therein. A locking screw extends inwardly of the recess from an upper surface of the lower portion to engage the aperture in one of the tabs. A ball is dimensioned for being received through the inverted U-shaped openings of the rectangular enclosure.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hockey game apparatus which has all the advantages of the prior art hockey implements and none of the disadvantages.

It is another object of the present invention to provide a new and improved hockey game apparatus which may be easily and efficiently manufactured and marketed.

It is a further object of the present invention to provide a new and improved hockey game apparatus which is of durable and reliable construction.

An even further object of the present invention is to provide a new and improved hockey game apparatus which is susceptible of a low cost of manufacture with regard to both materials and labor, and which accordingly is then susceptible of low prices of sale to the consuming public, thereby making such a hockey game apparatus economically available to the buying public.

Even still another object of the present invention is to provide a new and improved hockey game apparatus for playing a hockey game in an enclosed area.

Lastly, it is an object of the present invention to provide a new and improved hockey game apparatus including a playing surface defined by a rectangular enclosure. The rectangular enclosure has an open top end, an open bottom end and a peripheral boundary disposed therebetween. The enclosure has a plurality of openings therethrough. A pair of adjustably sized hockey sticks are included for slapping a ball. The ball is dimensioned for being received through the openings of the rectangular enclosure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
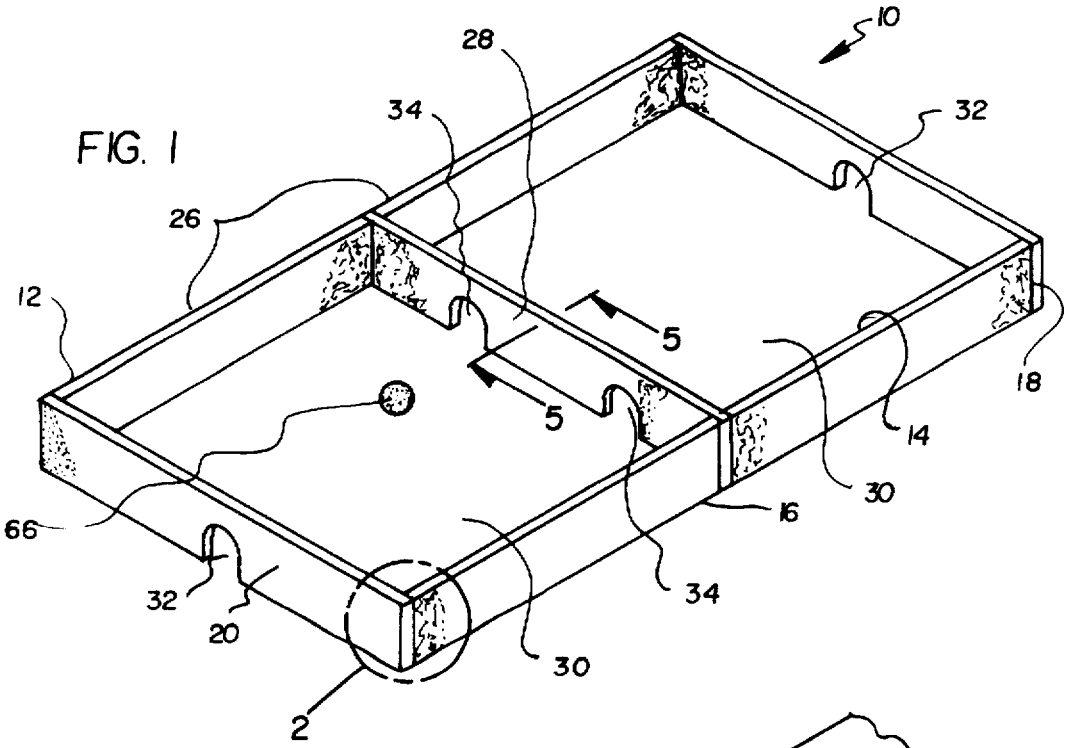
FIG. 1 is a perspective view of the preferred embodiment of the hockey game apparatus constructed in accordance with the principles of the present invention.
Figure 2:
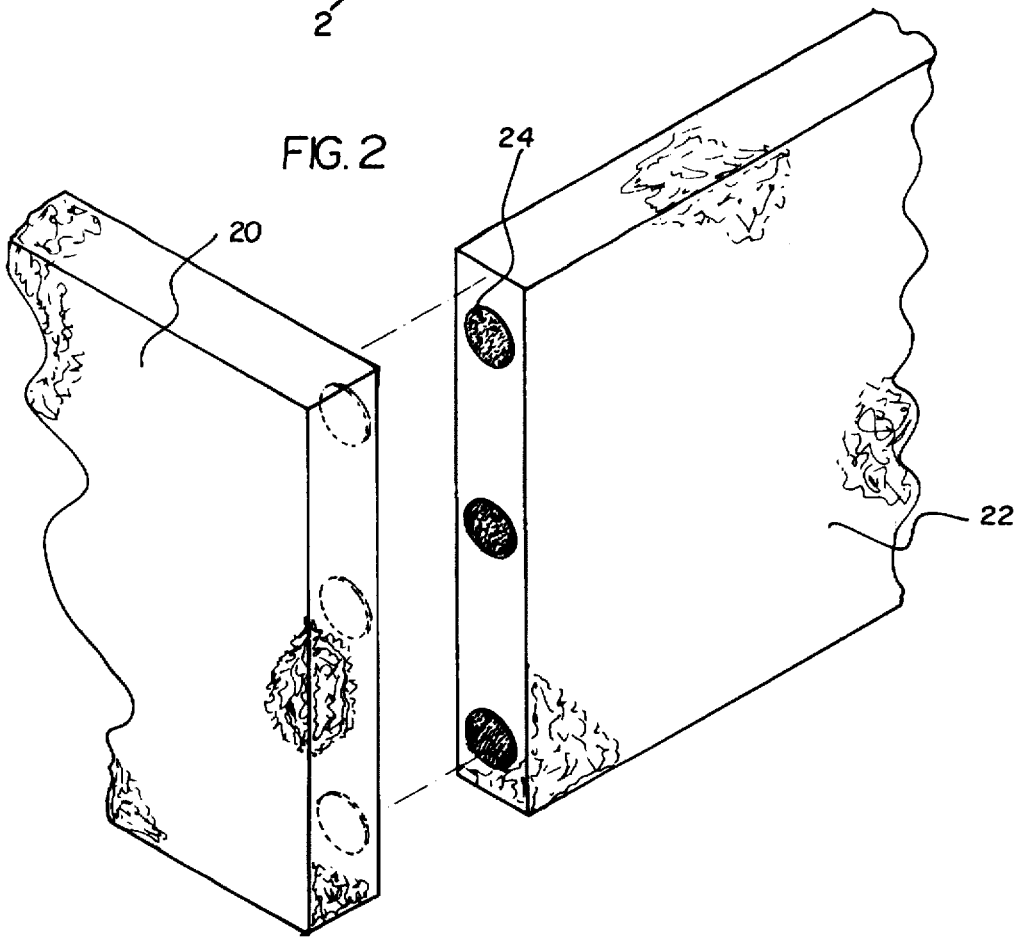
FIG. 2 is a perspective view of the peripheral wall of the present invention as taken from circle 2 of FIG. 1.

With reference now to the drawings, and in particular, to FIGS. 1 through 6 thereof, the preferred embodiment of the new and improved hockey game apparatus embodying the principles and concepts of the present invention and generally designated by the reference number 10 will be described.

Specifically, it will be noted in the various Figures that the device relates to a hockey game apparatus for playing a hockey game in an enclosed area. In its broadest context, the device consists of a playing surface, a pair of adjustably sized hockey sticks and a ball. Such components are individually configured and correlated with respect to each other so as to attain the desired objective.

The apparatus 10 includes a playing surface defined by a rectangular enclosure 12. Note FIG. 1. The rectangular enclosure has an open top end 14, an open bottom end 16 and a peripheral boundary 18 disposed therebetween. The rectangular enclosure could alternately be provided with a closed bottom end. In the preferred embodiment, the enclosure is placed on any recipient surface, thus the recipient surface becomes the playing surface. The peripheral boundary is further defined by opposed elongated side walls 22 and opposed shorter end walls 20 removably secured together at ends thereof. The end are secured together by any means known in the art. In the preferred embodiment, as viewed in FIG. 2, hook and loop fasteners 24 are employed. Each of the elongated side walls is further defined by a pair of segments 26 of equal lengths. The rectangular enclosure has a central divider 28 extending between the pair of segments of the opposed elongated side walls to divide the rectangular enclosure into two equally dimensioned playing zones 30. Each of the opposed shorter end walls have an inverted U-shaped opening 32 through a central portion thereof. These inverted U-shaped openings serve as goals for the opposing players involved in the game. The central divider has a pair of inverted U-shaped openings 34. The central divider has a recess 36 formed in an upper edge thereof intermediately disposed between the pair of inverted U-shaped openings.

Figures 3, 4:
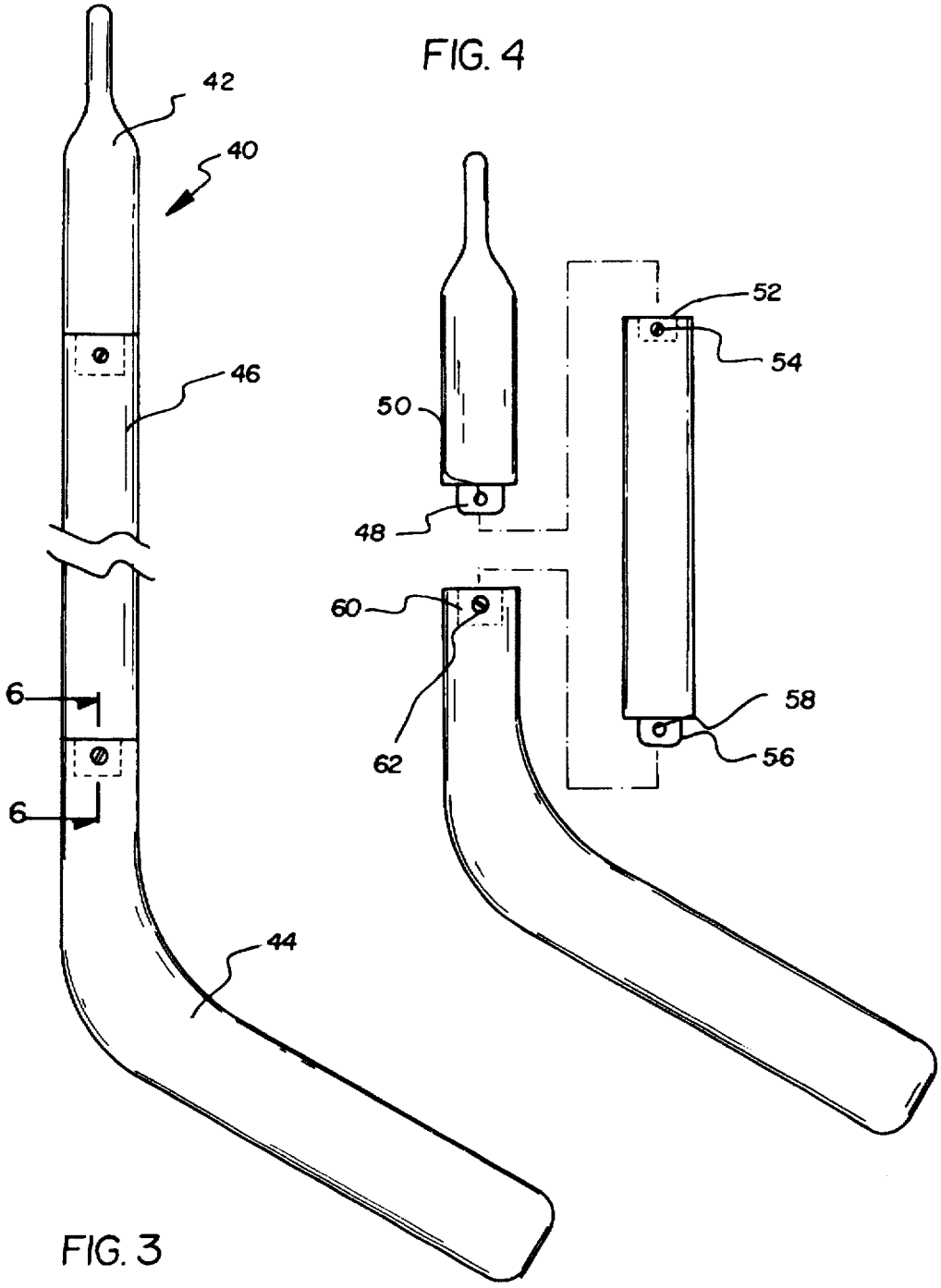
FIG. 3 is a front view of the hockey stick of the present invention.
FIG. 4 is a front view of the hockey stick as shown in FIG. 3 illustrating its adjustability.

The apparatus includes a pair of adjustably sized hockey sticks 40. Note FIGS. 3 and 4. The size of the hockey sticks can be adjusted for use of the game indoors and outdoors. A full size hockey stick, as illustrated in FIG. 3, is for use outdoors. A compact size hockey stick, as illustrated in FIG. 4, is for use indoors. Each of the hockey sticks has a linear upper portion 42, a generally L-shaped lower portion 44 and a linear intermediate portion 46 removably positioned therebetween. A lower end of the upper portion has a tab 48 extending outwardly therefrom. The tab has an aperture 50 therethrough. An upper end of the intermediate portion has a recess 52 formed inwardly thereof for selectively receiving the tab therein. A locking screw 54 extends inwardly of the recess from an upper surface of the intermediate portion to engage the aperture in the tab. A lower end of the intermediate portion has a tab 56 extending outwardly therefrom. The tab has an aperture 58 therethrough. An upper end of the lower portion has a recess 60 formed inwardly thereof for receiving one of the tabs therein. A locking screw 62 extends inwardly of the recess from an upper surface of the lower portion to engage the aperture in one of the tabs. The intermediate portion is simply removed and the upper and lower portions are secured together to form the hockey stick in the compact version.

Figure 5:
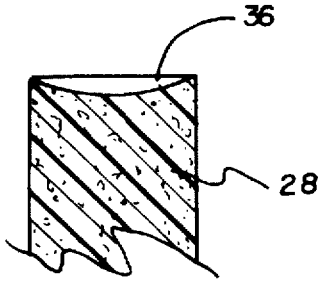
FIG. 5 is a cross-sectional view as taken along line 5—5 of FIG. 1.
Figure 6:
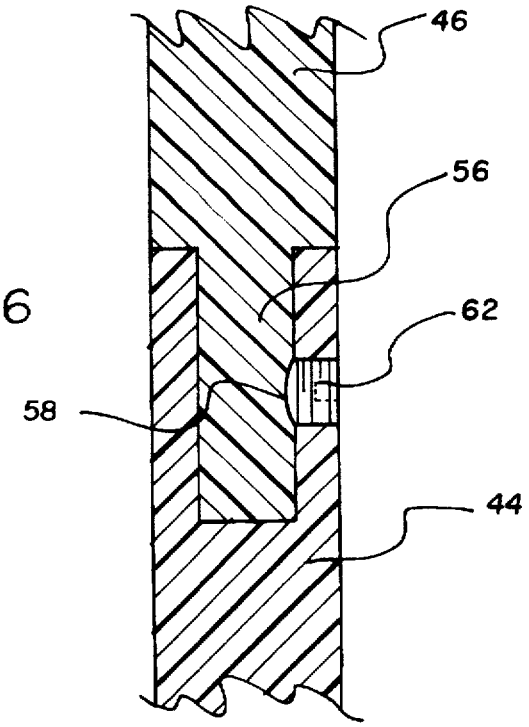
FIG. 6 is a cross-sectional view as taken along line 6—6 of FIG. 3.

A ball 66 is dimensioned for being received through the inverted U-shaped openings of the rectangular enclosure. The recess on the upper surface of the central divider is used to hold the ball therein at the start of a game. (FIG. 5)

RULES FOR PLAY

1. Place the ball on the face-off spot (the recess on the central divider).

2. Each player touches recipient surface with their hockey stick then raises the stick to ceremoniously touch the opposing players stick. Each player then immediately tries to hit the ball first into their respective playing zones.

3. Whichever side of the enclosure the ball lands in determines who won the face-off and determines who shoots first.

4. If the first shot does not go through the end opening (goal), the opposing player then gets the next shot. That shot would be aimed at, either of the two openings in the central divider.

5. Play continues until one player hits the ball through the end opening and scores a point.

6. Play continues, again, starting from step 1, until one player scores a predetermined amount of points first.

The method of play could also be altered for more than two players.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A hockey game apparatus for playing a hockey game in an enclosed area comprising, in combination:

a playing surface defined by a rectangular enclosure, the rectangular enclosure having an open top end, an open bottom end and a peripheral boundary disposed therebetween, the peripheral boundary further defined by opposed elongated side walls and opposed shorter end walls removably secured together at ends thereof, each of the elongated side walls being further defined by a pair of segments of equal lengths, the rectangular enclosure having a central divider extending between the pair of segments of the opposed elongated side walls to divide the rectangular enclosure into two equally dimensioned playing zones, each of the opposed shorter end walls having an inverted U-shaped opening through a central portion thereof, the central divider having a pair of inverted U-shaped openings, the central divider having a recess formed in an upper edge thereof intermediately disposed between the pair of inverted U-shaped openings;

a pair of adjustably sized hockey sticks, each of the hockey sticks having a linear upper portion, a generally L-shaped lower portion and a linear intermediate portion removably positioned therebetween, a lower end of the upper portion having a tab extending outwardly therefrom, the tab having an aperture therethrough, an upper end of the intermediate portion having a recess formed inwardly thereof for selectively receiving the tab therein, a locking screw extending inwardly of the recess from an upper surface of the intermediate portion to engage the aperture in the tab, a lower end of the intermediate portion having a tab extending outwardly therefrom, the tab having an aperture therethrough, an upper end of the lower portion having a recess formed inwardly thereof for receiving one of the tabs therein, a locking screw extending inwardly of the recess from an upper surface of the lower portion to engage the aperture in one of the tabs; and a ball dimensioned for being received through the inverted U-shaped openings of the rectangular enclosure.

2. A hockey game apparatus comprising:

a playing surface defined by a rectangular enclosure, the rectangular enclosure having an open top end, an open bottom end and a peripheral boundary disposed therebetween, the enclosure having a plurality of openings therethrough;

a pair of adjustably sized hockey sticks; and a ball dimensioned for being received through the openings of the rectangular enclosure wherein each of the hockey sticks have a linear upper portion, a generally L-shaped lower portion and a lower intermediate portion removably positioned therebetween;

wherein a lower end of the upper-portion has a tab extending outwardly therefrom, the tab having an aperture therethrough, an upper end of the intermediate portion having a recess formed inwardly thereof for selectively receiving the tab therein, a locking screw extending inwardly of the recess from an upper surface of the intermediate portion to engage the aperture in the tab, a lower end of the intermediate portion having a tab extending outwardly therefrom, the tab having an aperture therethrough, an upper end of the lower portion having a recess formed inwardly thereof for receiving one of the tabs therein, a locking screw extending inwardly of the recess from an upper surface of the lower portion to engage the aperture in one of the tabs.

* * * * *